US005402662A

United States Patent [19]

Osada

[11] Patent Number: 5,402,662

[45] Date of Patent: Apr. 4, 1995

[54] CYLINDRICAL LOCK AND KEY THEREFOR

[75] Inventor: Shunichi Osada, Yokohama, Japan

[73] Assignee: Alpha Corporation, Kawasaki, Japan

[21] Appl. No.: 92,473

[22] Filed: Jul. 16, 1993

[30] Foreign Application Priority Data

Feb. 26, 1993 [JP] Japan ..... 5-007581 U

[51] Int. Cl.[6] ..... E05B 27/00

[52] U.S. Cl. ..... 70/491; 70/404; 70/423

[58] Field of Search ..... 70/490, 491, 403, 404, 70/419, 423

[56] References Cited

U.S. PATENT DOCUMENTS

| | | | |
|---|---|---|---|
| 651,130 | 6/1900 | Carter | 70/491 |
| 3,343,386 | 9/1967 | Hall | 70/404 X |
| 3,494,159 | 2/1970 | Greenwald | 70/423 |
| 3,903,720 | 9/1975 | Scherbing | 70/491 |
| 4,083,211 | 4/1978 | Scherbing | 70/491 |
| 4,094,177 | 6/1978 | Wellekens | 70/423 |
| 4,111,020 | 9/1978 | Scherbing | 70/491 |
| 5,020,349 | 6/1991 | Lee | 70/491 |
| 5,024,072 | 6/1991 | Lee | 70/491 |
| 5,097,686 | 3/1992 | Plumer | 70/404 X |

FOREIGN PATENT DOCUMENTS

| | | | |
|---|---|---|---|
| 2450928 | 11/1980 | France | 70/403 |
| 300623 | 9/1932 | Italy | 70/404 |

*Primary Examiner*—Peter M. Cuomo
*Assistant Examiner*—Suzanne L. Dino
*Attorney, Agent, or Firm*—Foley & Lardner

[57] ABSTRACT

A cylindrical lock includes a casing having an annular front face with an inner circumferential portion surrounding a key insert member received by a key. A keyhole is defined between the inner circumferential portion and the key insert member, a lower portion of the key insert member is displaced from an axial center of a lock cylinder by a predetermined distance. The key includes a cylindrical end received by the key hole. A thickness of an upper side of the cylindrical end is different from a thickness of the lower end such that, when the key is rotated, the displaced lower side of the key insert member causes a width of portions of the keyhole to be varied. Thus picking of the cylindrical lock with a picking tool or the like is prevented.

5 Claims, 5 Drawing Sheets

CYLINDRICAL LOCK AND KEY THEREFOR

BACKGROUND OF THE INVENTION

1. Field of The Invention

The present invention relates generally to a cylindrical type lock. Specifically, the present invention relates to a cylindrical lock and a key therefor, which lock resists 'picking' for providing better lock security.

2. Description of The Prior Art

In conventional cylinder locks, a key is inserted in the axial direction of a lock cylinder. According to insertion of the key, the lock tumblers are caused to slide in the axial direction of the lock cylinder, allowing the key and the lock cylinder to be rotated for opening the lock. When the lock is in an unlocked state the key may not be extracted from the loci cylinder and loss of keys is thus prevented. Such types of cylindrical locks are utilized in public coin lockers and other such applications.

FIG. 8 shows a typical prior art construction of such a cylindrical lock. As may be seen in the drawing, the lock structure is comprised of a casing 110 having an inner circumferential portion 220. A projecting ring portion 30 of the casing 110 is extended at a front side of the casing 110. Between the projecting ring portion 30 and the inner circumferential portion 220, an annular step portion 40 is formed. A sleeve 50 is inserted in the inner circumferential portion 220 rearwardly of the annular step portion 40. The sleeve 50 is retained at the inner circumferential portion 220 by pins 70, which are inserted into openings 60 provided through the casing 110 and partially into the sleeve 50. The forward surface of the sleeve 50 forms an annular wall portion 80 within the inner circumferential portion 220. The annular wall portion 80 has a plurality of underpin openings 90 formed therein extending within the sleeve 50 in the axial direction of the cylindrical lock. Each of the underpin openings 90 houses a spring 100 which biases an underpin 111 in the forward direction such that the ends of the underpins 111 protrude from the surface of the annular wall portion 80.

A rotatable lock cylinder 120 has a key insert portion **120*a* at the forward side thereof. The key insert portion is received within the hollow cylindrical end portion of the key (not shown) when the key is inserted into the lock. A keyhole, or key insert opening 130 is defined between the key insert portion 120*a* of the lock cylinder 120*a* and the inner circumference of the projecting ring portion 30. An annular projecting portion 120*b* of the lock cylinder 120 slides against the surface of the annular wall portion 80 according to rotation of the lock cylinder 120. An axial portion 120*c* of the lock cylinder 120 projects from a rear side of the casing 110 through a cam 140 provided at a rear side of the casing 110. The axial portion 120*c* has a threaded outer circumference which receives a nut 270**.

According to the above, due to the provision of the sleeve 50 opposing the annular projecting portion **120*b* of the lock cylinder 120 and the nut 270 opposing the cam 140, movement of the lock cylinder 120 in the axial direction is prevented. In an unlocked condition of the cylindrical lock, the underpins 111 projected from the annular wall portion 80 oppose tumbler pin openings 150, each receiving therein a tumbler 160. In a locked condition of the cylinder lock the underpins 111 engage the tumbler pin openings 150 such that rotation of the lock cylinder 120 is impossible. In an unlocked state, when a key (not shown) is inserted into the keyhole 130, the ends of the tumblers 160 abut the projecting ends of the underpins 111** and rotation of the lock cylinder is permitted to effect unlocking of the cylindrical lock.

However, according to the above-described cylindrical lock arrangement, since the tumblers can be seen through the keyhole 130, it is possible to use an implement, such as a picking tool (not shown) to respectively push each tumbler so as to have the same effect as a key such that unauthorized unlocking of the lock is possible.

The purpose of the present invention is to provide a cylindrical lock in which such unauthorized unlocking, or 'picking' of the lock is surely prevented.

SUMMARY OF THE INVENTION

It is therefore a principal object of the present invention to overcome the drawbacks of the prior art.

It is a further object of the present invention to provide a cylindrical lock in which such unauthorized unlocking, or 'picking' of the lock is surely prevented.

In order to accomplish the aforementioned and other objects, a cylindrical lock and key therefor is provided, comprising: a lock casing having a substantially cylindrical inner circumferential portion, and a front portion having a circular opening provided therethrough in communication with the inner circumferential portion, a cylindrical sleeve mounted within the inner circumferential portion of the lock casing and having a front face having a plurality of first openings formed therein, a plurality of underpins arranged in the openings, each of the underpins being biased in a forward direction by a spring, a lock cylinder rotatably mounted axially within the lock casing and the sleeve, the lock cylinder including: an annular projecting portion, having a circumference greater than a main body portion of the lock cylinder, a rear face of the annular projecting portion in sliding contact with the front face of the sleeve, the rear face having formed therethrough a plurality of second openings positionally corresponding to the first openings at an initial position of the lock cylinder, a plurality of tumbler pins, one of the tumbler pins being provided in each of the second openings, a circular key insert portion provided at a forward end of the casing such that a substantially circular key insert opening is defined by a space between an outer circumference of the key insert portion and a circumference of the circular opening of the front portion of the casing, the circular key insert portion being eccentric to a rotational axis of the lock cylinder in one direction, a key receivable in the key insert opening and having a hollow cylindrical end portion receptive of the key insert portion of the lock cylinder, the cylindrical end portion having a plurality of tumbler pushing portions arranged on an outer circumference thereof so as to positionally correspond to the tumblers in an initial position of the key, corresponding to the initial position of the lock cylinder, a wall of the cylindrical end portion being thinner on a side thereof corresponding to the eccentric direction of the key insert portion and thicker on a side opposing the eccentric direction such that a width of the circular key opening is varied according to rotation of the key and the key cylinder.

DESCRIPTION OF THE PREFERRED EMBODIMENT

Figure 1:
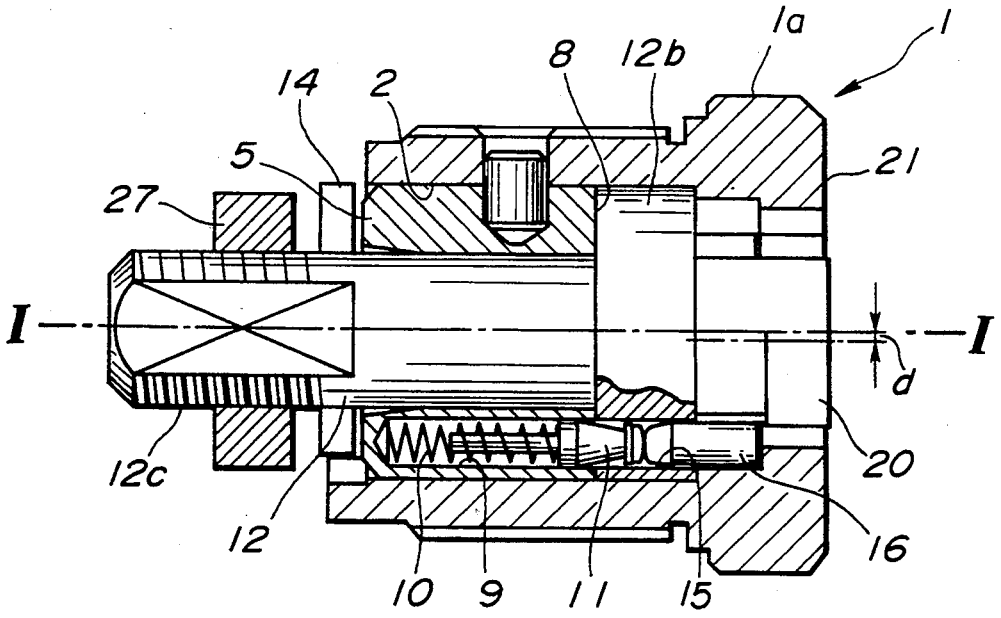
FIG. 1 is a cross-sectional view of a cylindrical lock according to the invention.

Referring now to the drawings, particularly to FIG. 1, a cylindrical lock 1 according to the invention comprises an outer casing 1*a* having an inner circumference 2 which houses a sleeve 5. The sleeve has an annular wall portion 8 disposed adjacent an annular projecting portion 12*b* of a lock cylinder 12. An axial portion 12*c* is inserted through a cam 14 and retained by a nut 27. A sleeve 5 is provided with underpin holes 9 into which springs 10 and underpins 11 are inserted. The projecting portion 12*b* has tumbler holes 15 into which tumblers 16 are inserted.

The lock cylinder 12 turns on a central axis I—I as also described in connection with the conventional cylindrical lock. It can be seen in FIG. 1 that a lower side of a key insert portion 20 disposed at the front side of the lock cylinder 12 is displaced from the central axis I—I in the downward direction only by a distance d as shown by broken lines in FIGS. 1 and 2.

Figure 2:
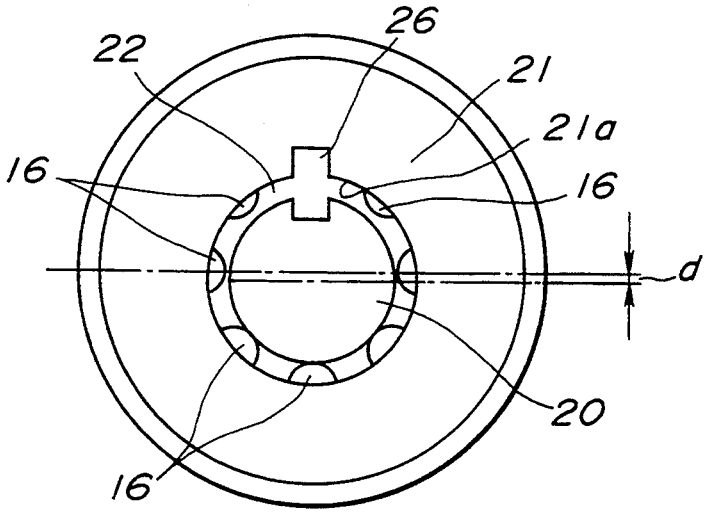
FIG. 2 is a front view of the cylindrical lock of FIG. 1.

Referring now to FIG. 2, the casing 1*a* has an annular front face 21 having an inner circumference 21*a* which surrounds the key insert portion 20. Since, as mentioned the key insert portion 20 is displaceable from the main axis I—I of the cylindrical lock 1, when no key is inserted, a width of a keyhole 22 defined between the inner circumference 21*a* of the front face 21 and the outer circumference of the key insert portion 20 is substantially uniform all around, as seen in FIG. 2.

Figure 3:
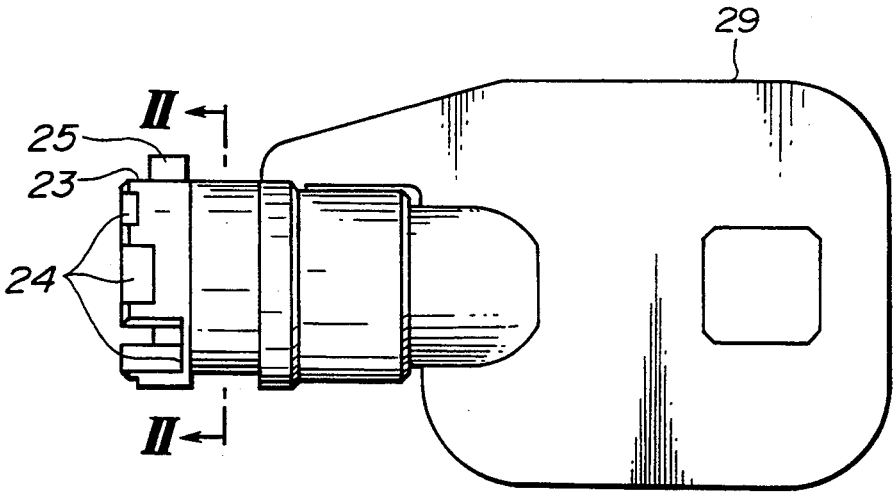
FIG. 3 is a side view of a key for the cylindrical lock of FIG. 1.
Figure 4:
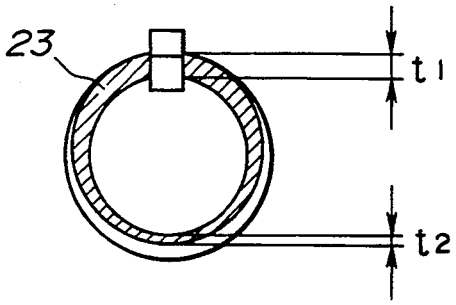
FIG. 4 is a cross-sectional front view of the key taken along line II—II of of FIG. 3.

Referring now to FIG. 3 a key 29 of the cylindrical lock 1 according to the invention, has an annular end portion 23. As seen in FIG. 4, a thickness of an upper side of the annular end portion 23 is of a greater thickness than a lower side of the annular end portion 23. According to this, the keyhole 22 becomes narrower at a side corresponding to the thinner side of the annular end portion 23 in response to turning of the lock cylinder 12 by rotation of the key 29 receiving the key insert portion 20 of the lock cylinder 12.

Specifically, according to the present embodiment, the amount of displacement d of the key insert portion is set to be 0.4 mm, while a thickness $t_1$ of of the upper side of the annular end portion 23 of the key 29 is established at 1 mm and a thickness $t_2$ of the lower side of the annular end portion 23 is established to be twice the displacement distance d, that is, the thickness $t_2$ is established at 0.2 mm.

Also, referring again to FIG. 3, tumbler pushing portions 24 are provided for each tumbler 16 around the annular end portion 23 of the key 29. A key alignment projection 25 is also provided at a top side of the annular end portion 23 which corresponds to a cut out 26 (see FIG. 2), formed at an upper side of the inner circumference 21*a* of the annular front face 21 of the casing 1*a* so as to establish a correct insertion angle of the key 29.

Hereinbelow, the operational functioning of a cylindrical lock 1 according to the present invention will be explained in detail.

Figure 5:
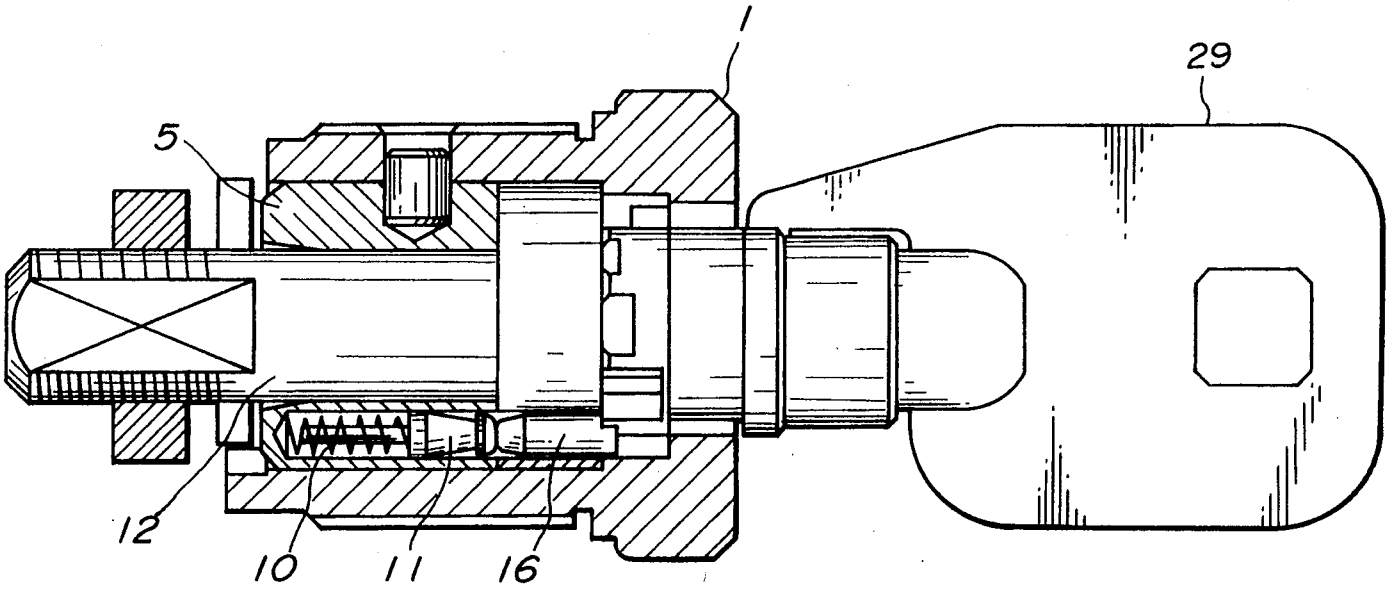
FIG. 5 is a cross-sectional view of the key of FIG. 3 inserted into the cylindrical lock of FIG. 1.

Initially, the structural components of the cylindrical lock 1 according to the invention are positioned as shown in FIG. 1, when no key is inserted thereinto. In this state, an annular width of the keyhole 22 is substantially uniform. Then, upon insertion, the key 29 having an end portion 23 with the different thicknesses $t_1$ and $t_2$ established at upper and lower sides thereof (FIG. 4) is inserted into the cylindrical lock 1 such that the tumbler pushing portions 24 corresponding to the positions of the tumblers 16 are caused to push the tumblers rearward, establishing an arrangement as shown in FIG. 5.

In this state, the tumblers 16 are contacted and in alignment with the underpins 11 and rotation of the lock cylinder 12 is possible.

Figure 6:
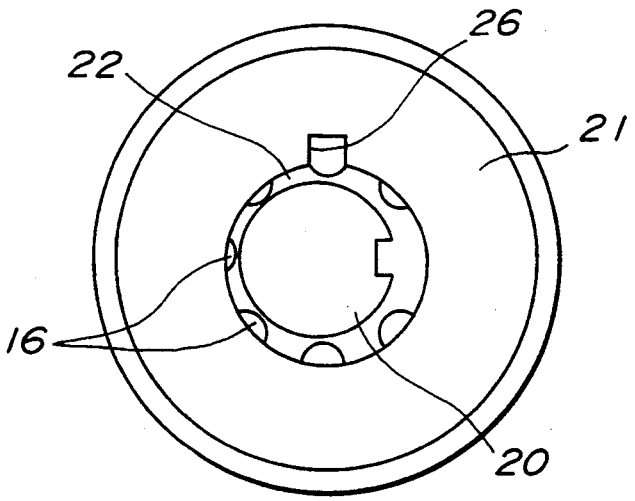
FIG. 6 is a front view of the cylindrical lock of the invention with the key inserted and turned 90°.
Figure 7:
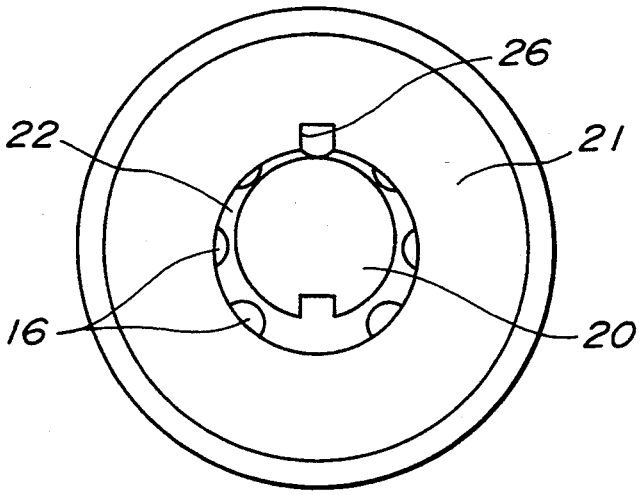
FIG. 7 is a front view of the cylindrical lock of the invention with the key inserted and turned 180°.
Figure 8:
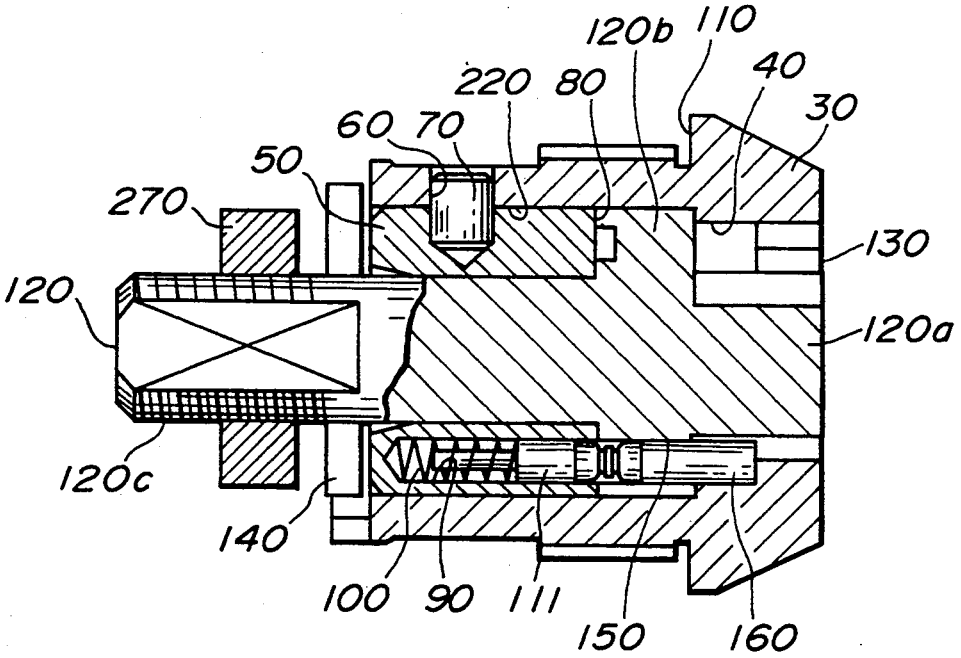
FIG.8 (PRIOR ART)
FIG. 8 is a cross-sectional view of a conventional cylindrical lock.

Then, when the key 29 is inserted into the keyhole 22 such that the key insert portion 20 is received within an interior space of the annular end portion 23, turning of the key 29 in an unlocking direction (clockwise according to the present embodiment) is possible. According to this, as seen in FIG. 6, when the key is turned 90°, the key insert portion 20 is displaced to the left, causing a left side of the keyhole 22 to become narrowed. Further, as seen in FIG. 7, when the key has been turned 180°, the key insert portion 20 is displaced such that the upper side of the keyhole 22 is narrowed, corresponding to the position of the narrow thickness $t_2$ of the end portion 23 and the key is positioned in the unlocked position.

According to this structure, if a picking tool is inserted into the key hole and used for individually pushing the tumblers for allowing rotation of the lock cylinder 12, the structure of the present invention will still prevent rotation of the lock cylinder 12 to the fully unlocked position since the picking tool cannot be fitted into the narrowing portions of the keyhole when the cylinder rotates. Lock security is thus greatly improved.

Thus, according to the present invention a cylindrical lock is provided in which picking and unauthorized unlocking is surely prevented and which provides a high level of lock security and improved reliability of the lock cylinder.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. A cylindrical lock and key therefor, comprising:

a lock casing having a cylindrical inner circumferential portion, and a front portion having a circular opening provided therethrough in communication with said inner circumferential portion;

a cylindrical sleeve mounted within said inner circumferential portion of said lock casing and having a front face having a plurality of first openings formed therein;

a plurality of underpins arranged in said first openings, each of said underpins being biased in a forward direction by a spring;

a lock cylinder mounted so as to be axially rotatable within said lock casing and said sleeve, said lock cylinder including:

an annular projecting portion, having a circumference greater than a main body portion of said lock cylinder, a rear face of said annular projecting portion in sliding contact with said front face of said sleeve, said rear face having formed therethrough a plurality of second openings positionally corresponding to said first openings at an initial position of said lock cylinder;

a plurality of tumbler pins, one of said tumbler pins being provided in each of said second openings;

a circular key insert portion provided at a forward end of said lock cylinder such that a substantially circular key insert opening is defined by a space between an outer circumference of said key insert portion and a circumference of said circular opening of said front portion of said casing, said circular key insert portion being eccentrically offset to a rotational axis of said lock cylinder in one direction; and a key receivable in said key insert opening and having a hollow cylindrical end portion receptive of said key insert portion of said lock cylinder, said cylindrical end portion having a plurality of tumbler pushing portions arranged on an outer circumference thereof so as to positionally correspond to said tumblers in an initial position of said key, corresponding to said initial position of said lock cylinder, a wall of said cylindrical end portion being thinner on a side thereof corresponding to the eccentric direction of said key insert portion and thicker on a side opposing said eccentric direction;

wherein according to insertion of said key into said key insert opening at said initial position, said rotational axis of said lock cylinder is aligned with a longitudinal axis of said key while said eccentric offset of said key insert portion is maintained, such that a width of said circular key insert opening is varied according to coaxial rotation of said key and said lock cylinder; and wherein circumferential engagement between an inner surface of said hollow cylindrical end portion of said key and an outer surface of said circular key insert portion is firmly established throughout said coaxial rotation.

2. A cylindrical lock and key therefor, comprising:

a lock casing having a substantially cylindrical inner circumferential portion, and a front portion having a circular opening provided therethrough in communication with said inner circumferential portion;

a cylindrical sleeve mounted within said inner circumferential portion of said lock casing and having a front face having a plurality of first openings formed therein;

a plurality of underpins arranged in said first openings, each of said underpins being biased in a forward direction by a spring;

a lock cylinder rotatably mounted axially within said lock casing and said sleeve, said lock cylinder including:

an annular projecting portion, having a circumference greater than a main body portion of said lock cylinder, a rear face of said annular projecting portion in sliding contact with said front face of said sleeve, said rear face having formed therethrough a plurality of second openings positionally corresponding to said first openings at an initial position of said lock cylinder;

a plurality of tumbler pins, one of said tumbler pins being provided in each of said second openings;

a circular key insert portion provided at a forward end of said casing such that a substantially circular key insert opening is defined by a space between an outer circumference of said key insert portion and a circumference of said circular opening of said front portion of said casing, said circular key insert portion being eccentric to a rotational axis of said lock cylinder in one direction:

a key receivable in said key insert opening and having a hollow cylindrical end portion receptive of said key insert portion of said lock cylinder, said cylindrical end portion having a plurality of tumbler pushing portions arranged on an outer circumference thereof so as to positionally correspond to said tumblers in an initial position of said key, corresponding to said initial position of said lock cylinder, a wall of said cylindrical end portion being thinner on a side thereof corresponding to the eccentric direction of said key insert portion and thicker on a side opposing said eccentric direction such that a width of said circular key opening is varied according to coaxial rotation of said key and said key cylinder, a thickness of said thinner side of said cylindrical end portion being twice an amount of displacement in said eccentric direction of said key insert portion.

3. A cylindrical lock and key therefor, comprising:

a lock casing having a substantially cylindrical inner circumferential portion, and a front portion having a circular opening provided therethrough in communication with said inner circumferential portion;

a cylindrical sleeve mounted within said inner circumferential portion of said lock casing and having a front face having a plurality of first openings formed therein;

a plurality of underpins arranged in said first openings, each of said underpins being biased in a forward direction by a spring;

a lock cylinder rotatably mounted axially within said lock casing and said sleeve, lock cylinder including:

an annular projecting portion, having a circumference greater than a main body portion of said lock cylinder, a rear face of said annular projecting portion in sliding contact with said front face of said sleeve, said rear face having formed therethrough a plurality of second openings positionally corresponding to said first openings at an initial position of said lock cylinder;

a plurality of tumbler pins, one of said tumbler pins being provided in each of said second openings;

a circular key insert portion provided at a forward end of said casing such that a substantially circular key insert opening is defined by a space between an outer circumference of said key insert portion and a circumference of said circular opening of said front portion of said casing, said circular key insert portion being eccentric to a rotational axis of said lock cylinder in one direction, an amount of displacement in said eccentric direction of said key insert portion being 0.4 mm;

a key receivable in said key insert opening and having a hollow cylindrical end portion receptive of said key insert portion of said lock cylinder, said cylindrical end portion having a plurality of tumbler pushing portions arranged on an outer circumference thereof so as to positionally correspond to said tumblers in an initial position of said key, corresponding to said initial position of said lock cylinder, a wall of said cylindrical end portion being thinner on a side thereof corresponding to the eccentric direction of said key insert portion and thicker on a side opposing said eccentric direction, a thickness of said thicker side being 1 mm and a thickness of said thinner side being 0.2 mm such that a width of said circular key opening is varied according to coaxial rotation of said key and said key cylinder.

4. A cylindrical lock and key therefor as set forth in claim 1, wherein said lock cylinder further includes an axial portion projecting rearwardly of said casing through a cam provided at a rear side of said casing, said axial portion having a threaded outer circumference receiving thereon a nut.

5. A cylindrical lock and key therefor as set forth in claim 1, further comprising a key alignment projection provided at one side of said cylindrical end portion of said key, and a corresponding cut out formed at a corresponding side of said circumference of said front portion of said casing so as to establish said initial position.

* * * * *